US006216289B1

(12) United States Patent
Woods

(10) Patent No.: US 6,216,289 B1
(45) Date of Patent: Apr. 17, 2001

(54) COMBINATION BEDDING FOUNDATION AND ADJUSTABLE HEIGHT BED FRAME

(75) Inventor: Robert C. Woods, Rockwall, TX (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/420,634

(22) Filed: Oct. 20, 1999

(51) Int. Cl.[7] ..... A47C 23/26

(52) U.S. Cl. ..... 5/200.1; 5/400; 5/264.1; 5/310

(58) Field of Search ..... 5/131, 400, 401, 5/200.1, 203, 204, 207, 264.1, 286, 305, 310

(56) References Cited

U.S. PATENT DOCUMENTS

| | | | | |
|---|---|---|---|---|
| 1,907,659 | * | 5/1933 | Pearce, Jr. | 5/264.1 |
| 2,263,050 | | 11/1941 | Rein . | |
| 2,480,025 | * | 8/1949 | Hunter | 5/207 X |
| 2,697,233 | | 12/1954 | Christenson . | |
| 2,712,137 | * | 7/1955 | Hunter | 5/310 X |
| 3,031,689 | | 5/1962 | Sark . | |
| 3,056,974 | * | 10/1962 | McKay | 5/286 X |
| 3,076,979 | * | 2/1963 | Hopkes, Jr. | 5/286 X |
| 3,197,789 | | 8/1965 | Ashkouti et al. . | |
| 3,621,497 | | 11/1971 | Fitzgerald . | |
| 3,725,966 | | 4/1973 | Blecker . | |
| 3,768,106 | | 10/1973 | Fitzgerald et al. . | |
| 3,810,264 | | 5/1974 | Mueller . | |
| 3,848,280 | | 11/1974 | Allen et al. . | |
| 4,038,710 | | 8/1977 | Tambascio . | |
| 4,080,674 | | 3/1978 | Fredman et al. . | |
| 4,354,287 | | 10/1982 | Fredman . | |
| 4,870,711 | | 10/1989 | Felix . | |
| 5,121,516 | | 6/1992 | Jones . | |
| 5,203,039 | | 4/1993 | Fredman . | |
| 5,231,713 | | 8/1993 | McDonnell . | |
| 5,459,892 | | 10/1995 | Wells et al. . | |
| 5,564,140 | | 10/1996 | Shoenhair et al. . | |
| 5,894,614 | | 4/1999 | Stroud . | |

* cited by examiner

*Primary Examiner*—Michael F. Trettel
(74) *Attorney, Agent, or Firm*—Wood, Herron & Evans, LLP

(57) ABSTRACT

A bedding product comprising a conventional box spring and a pair of support members secured to the inside of the frame of the box spring. Each of the support members comprises an angle element and a pair of brackets from which supporting, adjustable feet depend. The adjustable feet are fixed in position using wing nuts. By loosening the wing nuts and rotating the adjustable feet, the height of the box spring may be adjusted.

16 Claims, 3 Drawing Sheets

COMBINATION BEDDING FOUNDATION AND ADJUSTABLE HEIGHT BED FRAME

FIELD OF THE INVENTION

This invention relates to bedding products, and more particularly, to a combination box spring and bed frame.

BACKGROUND OF THE INVENTION

A conventional bedding system comprises a metal bed frame to which a headboard and footboard may be attached, a box spring resting upon the metal bed frame and a mattress resting upon the box spring. A popular common type of bed frame is a low metal bed frame known as a "Hollywood" bed frame. This relatively inexpensive metal frame may be used with or without a headboard and is particularly attractive to the public because of its low cost. Such an inexpensive Hollywood bed frame is collapsible and is relatively easy to assemble. Because the bed frame is a knock down or collapsible type of bed frame, the bed frame is usually packaged and shipped as a separate item requiring assembly by the purchaser at the desired location. Oftentimes, such assembly requires additional fasteners which are commonly lost or misplaced, thus requiring replacement and delaying assembly of the bed frame. Additionally, such Hollywood bed frames have many sharp edges which oftentimes tear or rip the upholstery surrounding a conventional box spring which rests upon the metal bed frame.

Such metal bed frames usually have one or more fixed legs depending downwardly from one or more members of the bed frame to which a caster wheel is attached, such as is disclosed in U.S. Pat. No. 4,038,710. With such metal bed frames, the height of the bed frame relative to the supporting surface or floor of the room in which the bed is located is fixed. Consequently, the height of the box spring and mattress are fixed. Oftentimes, consumers find the fixed height of the bed frame, box spring and mattress to be too high or low. Thus, there is a need for a metal bed frame having an adjustable height.

Several bed frames have been developed having adjustable heights, such as the one disclosed in U.S. Pat. No. 3,031,689. Additionally, applicant's own U.S. Pat. No. 5,894,614 discloses a center support system with legs of adjustable heights so as to adjust the height of a center support system adapted to be secured to a bed frame.

Attempts have been made to eliminate the metal bed frame by retrofitting a conventional box spring by supporting the box spring above the ground with a leg-type structure. U.S. Pat. No. 3,725,966 discloses such a bedding product. This patent discloses a conventional box spring having a framing member secured to each side rail of the box spring and a pair of leg structures pivotally connected to the framing members and extending therebetween. The leg structures are foldable against the underside of the box spring to facilitate shipment. Although the bedding product disclosed in U.S. Pat. No. 3,725,966 eliminates the need for a separate metal bed frame to support a box spring, the legs supporting the box spring off the ground are not adjustable so as to vary the height of the box spring. Additionally, the framing members disclosed in U.S. Pat. No. 3,725,966 are located on the outside of the bed frame, exposing the sharp edges of the framing members. Consequently, a person trying to get in or out of the bed may easily cut himself or herself. Additionally, the exposed edges of the framing members may catch and tear one's clothing.

Therefore, it has been one objective of the present invention to provide a bedding product which incorporates a portion of a bed frame thus eliminating the need for a separate metal bed frame to raise the bedding product off the ground.

It has been a further objective of the present invention to provide a bedding product having an adjustable height.

It has been a further objective of the present invention to provide a bedding product comprising a conventional box spring with a pair of opposed angle elements secured to the inside of the side rails of the bed frame in a relatively protected position.

SUMMARY OF THE INVENTION

The invention of this application which accomplishes these objectives comprises a bedding product made up of a conventional box spring and a pair of support members secured to the frame of the box spring. Each of the support members has a plurality of supporting, adjustable feet extending downwardly from the support member. The bedding product may be varied in height by rotating the feet secured to the support members. The height of the bedding product may be fixed by locking the feet at a specific height.

The bedding product of the present invention has a longitudinal dimension and a transverse dimension, the longitudinal dimension being greater than the transverse dimension, as is conventional in most bedding products. However, the present invention may be used with a square bedding product as well in which the longitudinal and transverse dimensions are identical. The bedding product of the present invention includes a box spring having a frame including a pair of longitudinally extending side rails and a pair of transversely extending end rails extending between the side rails. Additionally, a plurality of transversely extending cross slats extend between the side rails between the end rails of the frame and provide support for the springs of the box spring.

The support members are secured to the side rails of the box spring frame. Each of the support members comprises an angle element, a plurality of brackets secured to the angle element and a supporting, adjustable foot depending from each bracket. Each of the angle elements comprises a horizontal flange and vertical flange extending downwardly from the horizontal flange. The vertical flange of the angle element is secured to an inside surface of one of the side rails of the box spring frame, and the horizontal flange of the angle element is secured to at least one of the cross slats extending between the side rails of the box spring frame. Thus each of the support members is located inside one of the side rails of the box spring frame in a relatively hidden position. In such a position the outside edges of the angle elements are not exposed, but rather are located inside the end rails of the box spring frame where they are not able to catch an individual's clothing. Although the angle elements are most commonly made of iron and called angle irons, the angle elements may be made of any material including but not limited to steel or plastic.

Each of the brackets is secured to the vertical flange of one of the angle elements and has a planar portion and a cylindrical portion. The cylindrical portion has a bore or hole therein, inside which is located a plastic insert.

Each plastic insert has a body portion, a flange and a threaded thoroughbore extending through the body portion and the flange. The threaded thoroughbore is adapted to receive a threaded stem of an adjustable foot.

Each of the supporting, adjustable feet of the present invention comprises a threaded stem extending upwardly from a bottom member or base. The threaded stem threadably engages an insert located inside one of the brackets of one of the support members. A wing nut having a threaded interior hole therethrough is located immediately underneath the plastic insert, with the threaded stem of the adjustable foot passing through the threaded hole of the wing nut below the plastic insert. In order to fix the adjustable foot at a predetermined height the wing nut is rotated against the plastic insert.

The location of the angle elements of the support members inside the box spring frame protects the outer edges of the angle elements of the support members so they are unable to catch or snag a person's clothing or the upholstery surrounding the box spring. Additionally, the bedding product of the present invention avoids the use of a traditional metal bed frame and enables the height of a conventional box spring to be changed as desired. By merely rotating the adjustable feet extending downwardly from the brackets of the support members secured to the box spring frame, one can fix the height of the box spring.

These and other objects and advantages of this invention will be readily apparent from the following description of the drawings.

DETAILED DESCRIPTION OF THE DRAWINGS

Figure 1:
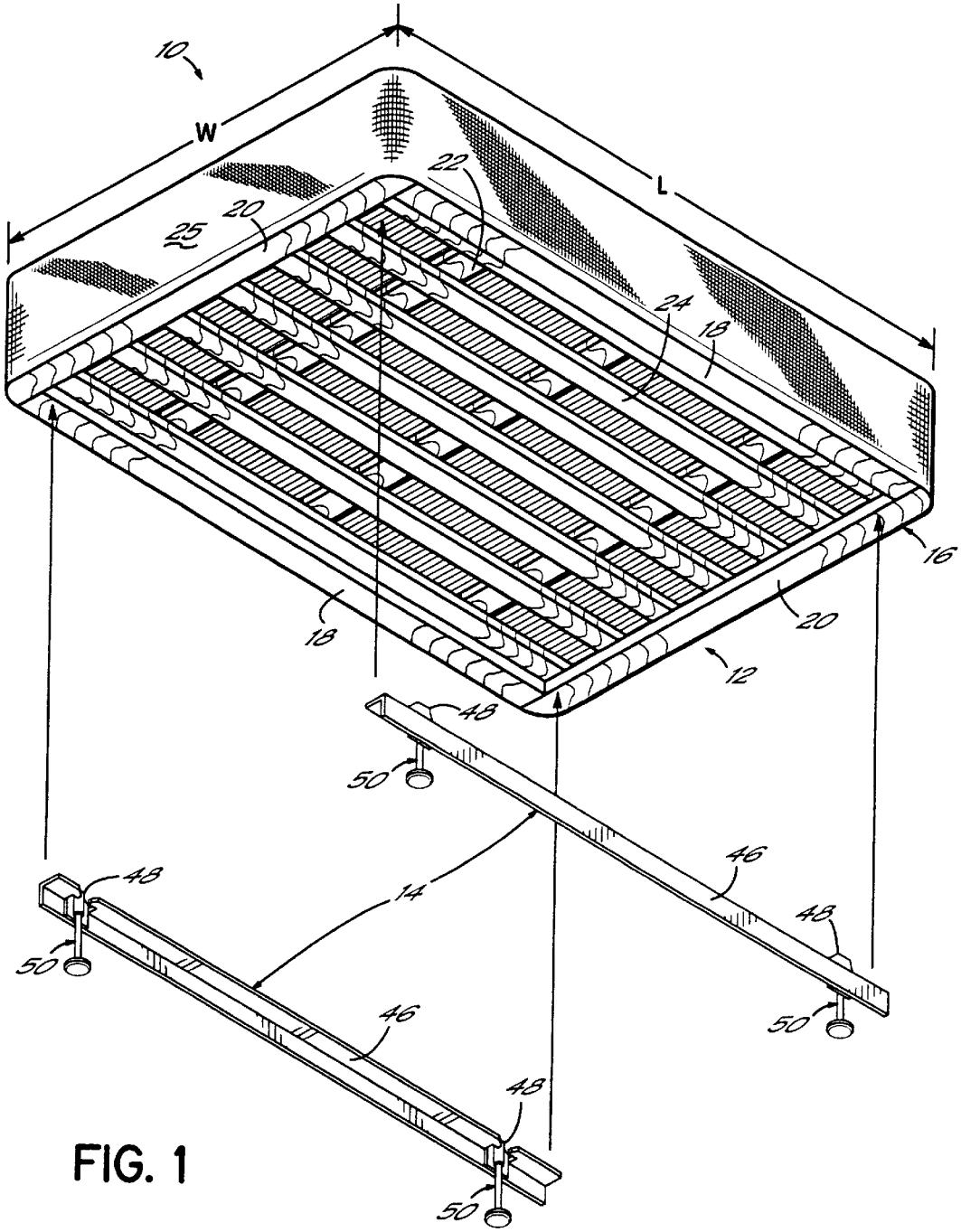
FIG. 1 is a partially exploded perspective view of the bedding product of the present invention comprising a conventional box spring, a pair of support members secured to the frame of the box spring including a plurality of supporting, adjustable feet.

Referring to the drawings, and particularly to FIG. 1, there is illustrated a bedding product 10 comprising a conventional box spring 12 and a pair of support members 14.

The bedding product 10 has a longitudinal dimension or length L and a transverse dimension or width W. Typically, the longitudinal dimension is greater than the transverse dimension, although the dimensions may be identical in a square bedding product.

The box spring 12 has a frame 16 comprising a pair of longitudinally extending side rails 18 and a pair of transversely extending end rails 20. As illustrated in FIG. 1, extending between the side rails 18 are a plurality of cross slats 22. Although just three cross slats 22 are illustrated in FIG. 1, any number of cross slats may be used in accordance with the present invention. FIG. 1 also illustrates a plurality of longitudinally extending intermediate slats 24 located between the side rails 18 of the box spring frame. As is conventional, a plurality of springs (not shown) are secured to the frame 16 and covered with an upholstered covering 25.

Figure 3:
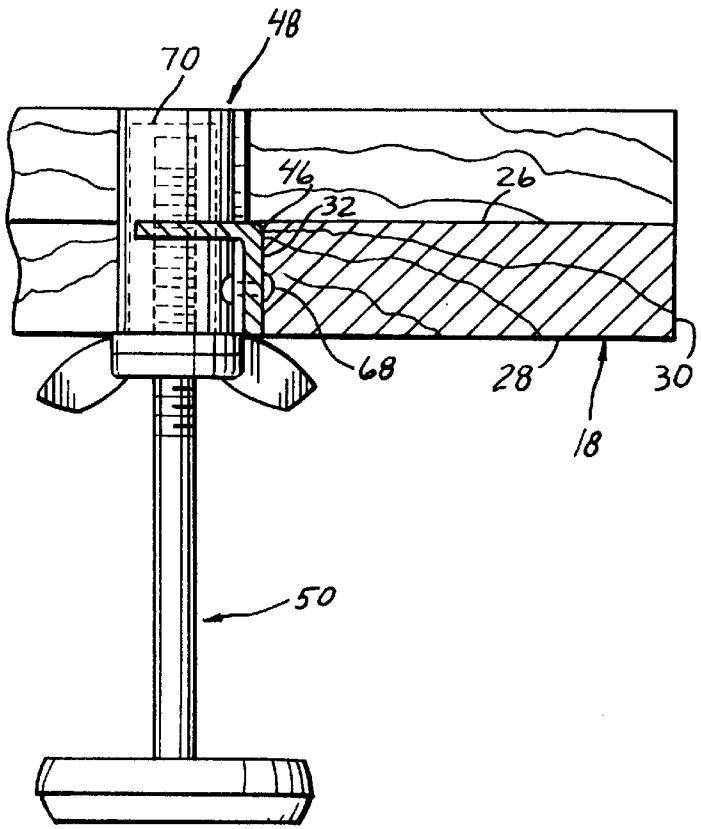
FIG. 3 is a view taken along the lines 3—3 of FIG. 2.
Figure 2:
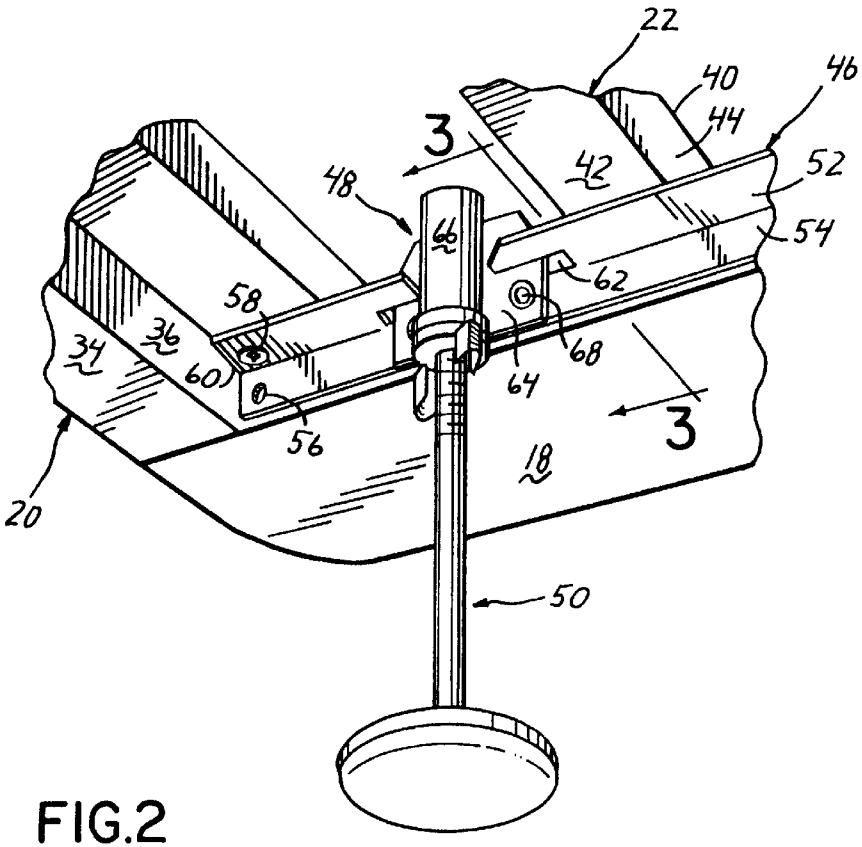
FIG. 2 is a perspective view of one of the corners of the bedding product of the present invention illustrating a portion of angle element, a bracket and a supporting, adjustable foot.

As best illustrated in FIGS. 2 and 3, each of the side rails 18 has a top surface 26, bottom surface 28, outside surface 30 and inside surface 32. Similarly, as illustrated in FIG. 2, each of the end rails 20 has a top surface (not shown), bottom surface 34, outside surface (not shown) and an inside surface 36. Additionally as illustrated in FIG. 2, each of the cross slats 22 has a top surface 40, a bottom surface 42 and a pair of opposed side surfaces 44.

Referring to FIG. 1, each of the support members 14 comprises an angle element 46, a pair of brackets 48 secured to the angle element 46 and a supporting, adjustable foot 50 extending downwardly from each of the brackets 46. Each supporting, adjustable foot 50 is threadably engaged with a portion of one of the brackets and may be changed in length by rotating the base of the foot. Although two brackets and feet are illustrated in FIG. 1 as depending downwardly from each of the support members 14, each support member 14 may have any number of brackets and supporting, adjustable feet. This application is not intended to limit the number of supporting, adjustable feet extending downwardly from the support members 14 or the number of brackets 48 secured to the angle elements 46.

As best illustrated in FIGS. 2 and 3, each of the angle elements 46 comprises a horizontal flange 52 and a vertical flange 54 extending downwardly from the horizontal flange 52. The angle element 46 is oriented so that the horizontal flange 52 extends inwardly from an upper portion of the vertical flange as illustrated in FIG. 3. Thus, as illustrated in FIG. 3, the angle element 46 has an L-shaped cross-sectional configuration.

In order to fixedly secure the angle element 46 to one of the side rails 18 of the frame 16, the vertical flange 54 of the angle element 46 is secured to the inside surface 32 of the side rail 18 of the frame 16 with fasteners 56, which may be screws, rivets or any other types of fasteners. Similarly, fasteners 58 (see FIG. 2) secure the horizontal flange 52 of the angle element 46 to at least one of the cross slats 22. These fasteners 56,58 fix the position of the angle element 46 in a location in which the angle element 46 is protected by the side and end rails of the frame. In such a position, the outside edges 60 of the angle element 46 are not exposed where they could cause injury to people either getting in or out of the bed, or bumping against the bed.

As best illustrated in FIG. 2, each angle element 46 has an end edge 60 which abuts against the inside surface 36 of one of the end rails 20 of the box spring frame. Thus the angle element 46 extends from the inside surface 36 of one end rail 20 longitudinally to the other inside surface of the other end rail 20 of the frame. However, this application does not intend to limit the length of either of the support members. Therefore, the support members 14 and more particularly the angle elements 46 may be of any length.

Alternatively, multiple individual pieces of support member may be secured to each side rail of the box spring frame, as opposed to one continuous support member 14 as is illustrated and described.

As best illustrated in FIG. 2, each of the horizontal flanges 52 of the angle element 46 has an opening 62 therein through which passes a bracket 48. Each bracket 48 has a planar portion 64 and a cylindrical portion 66. The planar portion 64 of the bracket is welded or otherwise secured with fasteners 68 to the vertical flange 54 of the angle element 46. The cylindrical portion 66 has a cylindrical bore 70 therein sized so as to receive a plastic insert 72 (see FIGS. 3 and 4).

Figure 4:
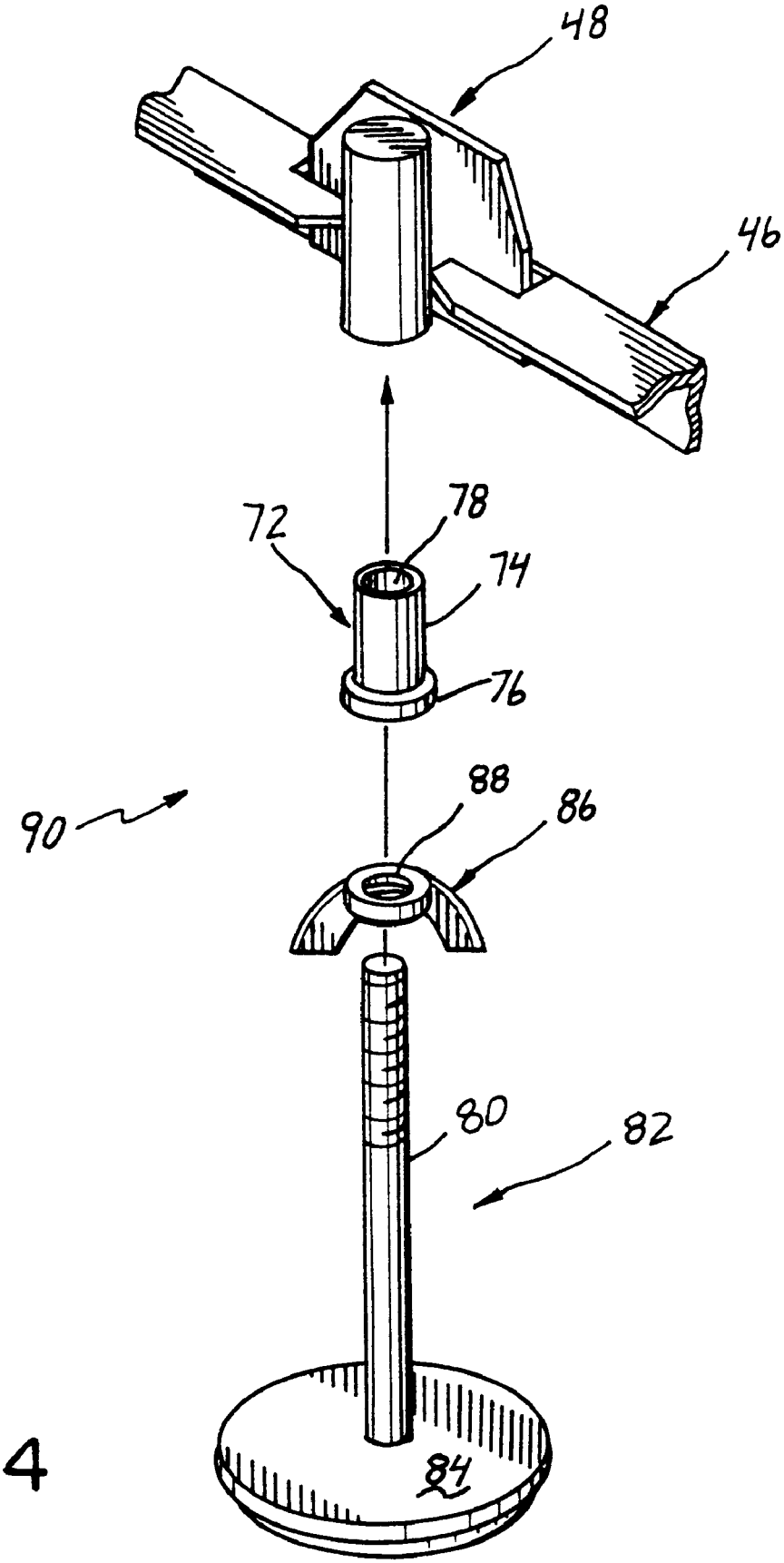
FIG. 4 is an exploded view of an adjustable foot assembly of the present invention, including a bracket, a supporting foot, a wing nut and a threaded insert.

Referring to FIG. 4, the plastic insert 72 has a body portion 74 and a flange 76. A threaded thoroughbore 78 extends through the body portion 74 and the flange 76 of the plastic insert. The threaded thoroughbore 78 is adapted to receive a threaded stem 80 of a supporting, adjustable foot 82. The adjustable foot 82 further comprises a base or bottom member 84, which is illustrated as being circular but may be any other configuration or shape.

As best illustrated in FIGS. 3 and 4, the plastic insert 72 resides inside the bore 70 of the cylindrical portion 66 of one of the brackets. The threaded stem 80 of an adjustable foot 82 is threadably engaged with the plastic insert 72 so that upon rotation of the adjustable foot, the height of the adjustable foot changes. A wing nut 86 having a threaded interior hole 88 is located underneath the plastic insert. The wing nut 86 is tightened in order to fix the height of the adjustable foot 82 as illustrated in FIGS. 2 and 3. The bracket 48, plastic insert 72, wing nut 86, and adjustable foot 82 make up a supporting foot assembly 90.

By rotating each of the supporting, adjustable feet 82 extending downwardly from the support members 14, a user may change the distance the frame 16 of the box spring 12 resides upon a supporting surface or floor. In order to facilitate shipment, the adjustable feet and wing nuts may be removed, thus a one-piece unit may be shipped to its desired located where it may be assembled without the need for a conventional metal bed frame.

While I have described one preferred embodiment of the bedding product of the present invention, persons skilled in the art will appreciate changes and modifications which may be made to the bedding product without departing from the spirit of the invention of this application. Therefore, I intend to be limited only by the scope of the following claims.

I claim:

1. A bedding product comprising:

a frame including a pair of longitudinally extending side rails and a plurality of transversely extending cross slats extending between said side rails above said side rails, a pair of angle elements secured to said side rails of said frame, each of said angle elements comprising a horizontal flange and a vertical flange extending downwardly from said horizontal flange, said vertical flange of each of said angle elements being secured to an inside surface of one of said side rails of said frame and said horizontal flange of each of said angle elements being secured to an underside of at least one of said cross slats, supporting feet secured to said angle elements and extending downwardly from said angle elements.

2. The bedding product of claim 1 further comprising brackets secured to each of said angle elements, said supporting feet extending downwardly from said brackets.

3. The bedding product of claim 2 wherein each of said supporting feet comprises a threaded stem extending upwardly from a bottom member, said threaded stem being threadably engaged with an insert located in one of said brackets.

4. The bedding product of claim 1 wherein said frame is wooden.

5. The bedding product of claim 1 wherein said frame is a wooden.

6. A bedding product comprising:

a frame including a pair of side rails, a pair of end rails and a plurality of cross slats, said end rails and said cross slats extending between said side rails, a pair of angle elements secured to said side rails of said frame, each of said angle elements comprising a horizontal flange and a vertical flange extending downwardly from said horizontal flange, said vertical flange of said angle element being secured to an inside surface of one of said side rails of said frame and said horizontal flange of said angle element being secured to at least one of said cross slats of said frame, a plurality of brackets secured to each of said angle elements, each of said brackets having a plastic insert therein, said plastic insert having a threaded thoroughbore, a plurality of adjustable feet, each of said adjustable feet comprising a threaded stem extending upwardly from a bottom member adapted to rest on a supporting surface, said threaded stem of said adjustable foot being threadably engaged with said threaded thoroughbore of said plastic insert so that upon rotation of said adjustable foot, the distance between said bottom member of said adjustable foot and said frame is changed.

7. The bedding product of claim 6 wherein each of brackets is secured to said vertical flange of said angle element.

8. The bedding product of claim 6 further comprising a wing nut having a threaded interior hole therethrough, said threaded stem of said adjustable foot passing through said threaded hole of said wing nut below said plastic insert such that upon rotation of said wing nut said adjustable foot is locked in place.

9. The bedding product of claim 6 wherein said plastic insert comprises a body portion and a flange, said threaded thoroughbore extending through said body portion and said flange of said plastic insert.

10. A bedding product comprising:

a frame including a pair of longitudinally extending side rails and a plurality of transversely extending slats extending between said side rails, a pair of angle elements secured to said side rails of said frame, each of said angle elements comprising a horizontal flange and a vertical flange extending downwardly from said horizontal flange, said vertical flange of each of said angle elements being secured to an inside surface of one of said side rails of said frame and said horizontal flange of each of said angle elements being secured to an underside of at least one of said slats, supporting feet secured to said angle elements and extending downwardly from said angle elements;

brackets secured to each of said angle elements, said supporting feet extending downwardly from said brackets, each of said supporting feet comprising a threaded stem extending upwardly from a bottom member, said threaded stem being threadably engaged with an insert located in one of said brackets; and a wing nut having a threaded interior hole therethrough, said threaded stem of said supporting foot passing through said threaded interior hole of said wing nut below said insert such that upon rotation of said wing nut said supporting foot has a fixed height.

11. A bedding product comprising:

a box spring having a frame including a pair of longitudinally extending side rails, a pair of transversely extending end rails and a plurality of transversely extending cross slats extending between said side rails, said cross slats being above said side rails, a pair of support members secured to said frame of said box spring, each of said support members comprising an angle element secured to one of said side rails of said frame, said angle element comprising a horizontal flange and a vertical flange extending downwardly from said horizontal flange, said vertical flange of said angle element being secured to an inside surface of said one of said side rails of said box spring frame and said horizontal flange of said angle element being secured to at least one of said cross slats of said box spring frame, each of support members further comprising a plurality of brackets secured to said angle element, a plurality of inserts located inside said brackets, and a plurality of adjustable feet, each of said adjustable feet being threadably engaged with one of said inserts.

12. The bedding product of claim 11 wherein each of said inserts comprises a body portion, a flange and a threaded thoroughbore extending through said body portion and said flange.

13. The bedding product of claim 11 wherein each of said adjustable feet comprises a threaded stem extending upwardly from a bottom member, said threaded stem being threadably engaged with said threaded thoroughbore of said insert.

14. A bedding product comprising:

a box spring having a frame including a pair of longitudinally extending side rails, a pair of transversely extending end rails and a plurality of transversely extending cross slats extending between said side rails, a pair of support members secured to said frame of said box spring, each of said support members comprising an angle element secured to one of said side rails of said frame, said angle element comprising a horizontal flange and a vertical flange extending downwardly from said horizontal flange, said vertical flange of said angle element being secured to an inside surface of said one of said side rails of said box spring frame and said horizontal flange of said angle element being secured to at least one of said cross slats of said box spring frame, each of support members further comprising a plurality of brackets secured to said angle element, a plurality of inserts located inside said brackets, and a plurality of adjustable feet, each of said adjustable feet being threadably engaged with one of said inserts wherein each of said brackets comprises a cylindrical portion inside which is located one of said inserts.

15. A bedding product comprising:

a box spring having a frame including a pair of longitudinally extending side rails, a pair of transversely extending end rails and a plurality of transversely extending cross slats extending between said side rails, a pair of support members secured to said frame of said box spring, each of said support members comprising an angle element secured to one of said side rails of said frame, said angle element comprising a horizontal flange and a vertical flange extending downwardly from said horizontal flange, said vertical flange of said angle element being secured to an inside surface of said one of said side rails of said box spring frame and said horizontal flange of said angle element being secured to at least one of said cross slats of said box spring frame, each of support members further comprising a plurality of brackets secured to said angle element, a plurality of inserts located inside said brackets, and a plurality of adjustable feet, each of said adjustable feet being threadably engaged with one of said inserts wherein each of said brackets comprises a planar portion secured to said vertical flange of said support member.

16. A bedding product comprising:

a box spring having a frame including a pair of longitudinally extending side rails, a pair of transversely extending end rails and a plurality of transversely extending cross slats extending between said side rails, a pair of support members secured to said frame of said box spring, each of said support members comprising an angle element secured to one of said side rails of said frame, said angle element comprising a horizontal flange and a vertical flange extending downwardly from said horizontal flange, said vertical flange of said angle element being secured to an inside surface of said one of said side rails of said box spring frame and said horizontal flange of said angle element being secured to at least one of said cross slats of said box spring frame, each of support members further comprising a plurality of brackets secured to said angle element, a plurality of inserts located inside said brackets, and a plurality of adjustable feet, each of said adjustable feet comprising a threaded stem extending upwardly from a bottom member, said threaded stem being threadably engaged with a threaded thoroughbore of one of said inserts, said bedding product further comprising a wing nut having a threaded hole therethrough, said threaded stem of said adjustable foot passing through said threaded hole of said wing nut below said insert such that upon rotation of said wing nut said adjustable foot is locked in place.

* * * * *